US006129396A

United States Patent [19]

Asada et al.

[11] Patent Number: 6,129,396

[45] Date of Patent: Oct. 10, 2000

[54] CONTAINER-PILING SPREADER

[75] Inventors: Hiroshi Asada; Haruhiko Tsuzuki, both of Niihama, Japan

[73] Assignee: Sumitomo Heavy Industries, Ltd., Tokyo, Japan

[21] Appl. No.: 09/158,104

[22] Filed: Sep. 24, 1998

[30] Foreign Application Priority Data

Dec. 15, 1997 [JP] Japan ..... 9-363483

[51] Int. Cl.[7] ..... B66C 1/66

[52] U.S. Cl. ..... 294/86.41; 294/81.21; 294/81.41; 294/81.51

[58] Field of Search ..... 294/86.41, 81.2, 294/81.21, 81.4, 81.41, 81.5, 81.51, 81.54, 67.31, 67.33, 67.5

[56] References Cited

U.S. PATENT DOCUMENTS

| | | | |
|---|---|---|---|
| 3,752,346 | 8/1973 | Thompson et al. | 294/81.21 |
| 3,789,998 | 2/1974 | Fathauer et al. | 294/81.21 |
| 4,736,971 | 4/1988 | McManus | 294/81.54 |
| 5,257,891 | 11/1993 | Baumann et al. | 294/81.4 |
| 5,354,112 | 10/1994 | Hara et al. | 294/81.41 |
| 5,560,663 | 10/1996 | Hara et al. | 294/81.41 |
| 5,769,250 | 6/1998 | Jussila et al. | 294/81.4 |

FOREIGN PATENT DOCUMENTS

| | | | |
|---|---|---|---|
| 0 263 087 | 4/1968 | European Pat. Off. . | |
| 1908293 | 9/1970 | Germany | 294/81.4 |
| 2529048 | 12/1996 | Japan . | |
| 2601394 | 1/1997 | Japan . | |
| 2 262 273 | 6/1993 | United Kingdom . | |
| 2 278 337 | 11/1994 | United Kingdom . | |

*Primary Examiner*—Dean J. Kramer
*Assistant Examiner*—Paul T. Chin
*Attorney, Agent, or Firm*—Arent Fox Kintner Plotkin & Kahn PLLC

[57] ABSTRACT

A container-piling spreader which prevents the positional slippage of the lower container, comprising (i) a spreader body having, on the four corners of its bottom surface, means for engaging and hanging a container, (ii) a pair of elevation guides, each elevation guide mounted on the opposite end of the spreader body swingably in a vertical plane and being extensible downward and contractible upward, (iii) a pair of guide frames, each guide frame mounted, horizontally and in the direction of width of the container, on the bottom of one of the paired elevation guides, (iv) a retractable stopper, provided on each guide frame, to catch the bottom of the container, (v) two pairs of guide flippers, the guide flippers of each pair mounted on both ends of one of the paired guide frames, (vi) two pairs of guide sheaves, each guide sheave mounted on a side of one of the guide flippers, (vii) one pair or two pairs of winches mounted on the spreader body, and (viii) two pairs of pulling strings, each pulling string wound on one of the winches and going around its corresponding guide sheave and further upward to the spreader body to be fixed thereto.

6 Claims, 15 Drawing Sheets

CONTAINER-PILING SPREADER

BACKGROUND OF INVENTION

The present invention relates to a container-piling spreader.

Spreaders are used for the loading and unloading of containers. As shown in FIGS. 17 and 18, the spreader body 102 of a spreader is as large as the top area of a container, and twist locks 103 and guide flippers 104 are arranged at the four corners of the spreader body 102.

To hoist a container C with such a spreader, a crane (not shown) winds down wire ropes 105 to let the spreader down. The guide flippers 104 position the spreader onto the container, and the twist locks 103 engage the four corners of the container C. The crane hoists up and carries the container C to its appointed place.

A number of containers are often piled up in storage yards. To place a container on containers already piled, it is necessary to position the container exactly on the immediately lower container. The present invention relates to a spreader suitable to such positioning.

Positioning means for piling up containers are disclosed in Japanese Patent No. 2601394 (prior art I) and Japanese Utility Model Registration No. 2529048 (prior art II).

An embodiment of the prior art I is illustrated in FIG. 19. Guide flippers 116 are ascendable and descendable by elevating devices 115 mounted on the spreader, and so arranged that they can be positioned at the four corners of the spreader. While a container C is hoisted by the spreader, the elevating devices 115 lower the guide flippers 116 so as to protrude their slightly expanded lower portions 117 beyond the bottom of the container C, and the flippers 116 are locked by locking devices such as hooks, magnets, pins, or tying ropes.

In accordance with the prior art I, containers can be piled up as follows. As shown in FIG. 19(*a*), while the guide flippers 116 are in their upper positions, they are locked at the four corners of the spreader body 111 by the locking devices. Then, as shown in FIG. 19(*b*), the spreader body 111 is lowered on a container C, and the twist locks 119 are, by remote control, engaged with the metal fittings on the container C to hoist it. Next, as shown in FIG. 19(*c*), the guide flippers 116 are lowered by the elevating devices 115 until the slightly expanded lower portions 117 protrude beyond the bottom of the container C. The guide flippers 116 are locked to the four corners of the container C by the locking devices.

Then, the container C is carried by the crane to and above another container C1. When the container C is lowered onto the container C1, the guide flippers 116 guide and position the container C exactly on the container C1.

In an embodiment of the prior art II, the spreader comprises a spreader body, guide frames with guide flippers for engaging and positioning a container, elevating devices to support the guide frames under the spreader body, winches mounted on the spreader body, and wire ropes which go from the winches in the longitudinal direction of the spreader body to one side of the spreader body, and down to the guide frame on the side, and further to the guide frame on the opposite side to be connected thereto.

According to the prior art II, the guide flippers are locked onto the bottom portions of a container by the wire ropes, but its method of piling a container on another is the same as the method of the prior art I.

The anticipated shortcomings of the prior art I are as follows:

(a) Because the guide flippers 116 are locked, or fixed, to the bottom corners of a container G, which is hoisted by the spreader, by locking devices such as hooks or pins, large vertical and horizontal forces occur on the guide flippers 116 when the container C is lowered onto the lower container C1. These forces often cause positional slippage of the lower container C1 or damage to the guide flippers 116 and the container C.

(b) To lock the guide flippers 116 and their guide frames onto the container C by hooks, pins, or the likes, actuators, such as cylinders and pins, and other components are necessary, which makes the locking devices complex and the ascending/descending portions heavy, which in turn makes the elevating and other devices large, which further in turn requires a crane of large capacity. Some pins for locking the guide flippers 116 will not enter the holes of the metal fittings on the bottom corners of a container, if it is deformed.

(c) As it is difficult to take appropriate preventive measures for the hooks and pins against excessive forces, they have to be given relatively large strength, which makes them and their related members larger and heavier.

(d) Because the locking devices of the guide flippers, which are exposed to large external forces and shocks, are complex and no preventive measures are taken against such forces and shocks, the spreader has a relatively short operating life due to abrasion and fatigue. In addition, electric components such as sensors mounted on the guide flippers to regulate the timing of the operations of hooks, pins, and so on are generally susceptible to shocks; therefore, they tend to raise the failure rate of the spreader system and increase the down time of the crane itself.

The anticipated shortcomings of the prior art II are as follows:

(e) Because the guide flippers are pulled, in the longitudinal direction of the container, onto the container surfaces by the tension of the wire ropes alone, and the spans of the wire ropes are large (about 12 m), the pulling forces on the guide flippers are often disturbed by the deflection and vibration due to the rope sags. As the rope spans are large, it is necessary to apply large tension to the wire ropes; therefore, it is necessary to take some measures to prevent the guide frames from being drawn upward by the rope tension.

(f) When the guide frames are lowered and raised, the protrusions and door knobs on the surfaces of the container may interfere with the downward and upward movement of the guide frames.

In accordance with the above, the object of the present invention is to provide a container-piling spreader which does not cause positional slippage of lower containers, is easy to position its guide flippers on a container, has simple and strong structure without dispensable locking means, guides containers reliably, and is safe to operate.

SUMMARY OF THE INVENTIONS

According to the first aspect of the present invention, there is provided a container-piling spreader comprising (i) a spreader body having, on the four corners of its bottom surface, means for engaging and hanging a container, (ii) a pair of elevation guides, each elevation guide mounted on the opposite end of the spreader body swingably in a vertical plane and being extensible downward and contractible upward, (iii) a pair of guide frames, each guide frame mounted, horizontally and in the direction of width of the container, on the bottom of one of the paired elevation guides, (iv) two pairs of guide flippers, the guide flippers of each pair mounted on both ends of one of the paired guide frames, (v) two pairs of direction-changing guides, each direction-changing guide mounted on a side of one of the guide flippers, (vi) one pair or two pairs of winches mounted on the spreader body, and (vii) two pairs of pulling strings, each pulling string wound on one of the winches and going around its corresponding direction-changing guide and further upward to the spreader body to be fixed thereto.

According to the second aspect of the present invention, there is provided a container-piling spreader comprising (i) a spreader body having, on the four corners of its bottom surface, means for engaging and hanging a container, (ii) a pair of elevation guides, each elevation guide mounted on the opposite end of the spreader body swingably in a vertical plane and being extensible downward and contractible upward, (iii) a pair of guide frames, each guide frame mounted, horizontally and in the direction of width of the container, on the bottom of one of the paired elevation guides, (iv) two pairs of guide flippers, the guide flippers of each pair mounted on both ends of one of the paired guide frames, (v) two actuating means for extending and contracting the paired elevation guides, (vi) one pair or two pairs of winches mounted on the spreader body, and (vii) two pairs of pulling strings, each pulling string wound on one of the winches and going to an appropriate point on its corresponding guide frame or to an appropriate point on its corresponding guide flipper to be fixed at the point.

According to the third aspect of the present invention, the guide frames of the container piling spreader by the first or second aspect of the invention are each provided with a retractable stopper which can be advanced to catch the bottom of the container hoisted by the spreader body and retracted from its advanced position.

According to the fourth aspect of the present invention, the spreader body of the container-piling spreader by the first, second, or third aspect of the invention comprises (i) a pair of main beams lying in the longitudinal direction of the container, (ii) two pairs of inner beams, the inner beams of each pair built in one of the main beams and being protrusible and retractable at the opposite end of the main beam, and (iii) a pair of connecting beams lying in the direction of width of the container, each mounted on the outer ends of the inner beams on the opposite side, front or back, of the container. The means for engaging and hanging a container are mounted on the bottoms of the connecting beams at their both ends. Besides, each of the guide frames comprises (i) an outer tube, (ii) a pair of inner tubes, each protrusible and retractable at the opposite end of the outer tube, and (iii) a pair of actuating means for the pair of inner tubes. The guide flippers are mounted on the outer ends of the inner tubes.

According to the fifth aspect of the present invention, the guide frames of the container-piling spreader by the first, second, third, or fourth aspect of the invention are each provided with a pair of rollers which roll on the front and back of the container, keeping a certain distance between the container and the guide frames while the guide frames are ascending or descending.

According to the sixth aspect of the present invention, the container-piling spreader by the first, second, third, or fourth aspect of the invention is provided, on each side of the front and back of the container, with a tilting means between the spreader body and the elevation guide to tilt the elevation guide in a vertical plane.

According to the seventh aspect of the present invention, the winches of the container-piling spreader by the first, second, third, fourth, fifth, or sixth aspect of the invention are each driven by an oil-hydraulic motor. Besides, each oil-hydraulic motor is provided with a relief valve which is connected between the two pipes leading to the two inlet/outlet ports of the oil-hydraulic motor.

According to the eighth aspect of the present invention, the container-piling spreader by the first, second, third, fourth, fifth, sixth, or seventh aspect of the invention is provided with oil-hydraulic cylinders as the actuating means for the inner tubes of the guide frames. Besides, a relief valve is connected between the two pipes leading to the two chambers, one for extension and the other for contraction, of each oil-hydraulic cylinder.

The sixth and seventh aspects of the present invention may be practiced individually, or may be practiced collectively to draw more advantage from them.

"Pulling strings" mentioned in the present invention is a concept inclusive of chains and the likes as well as wire ropes; "direction-changing guides," a concept inclusive of sprockets and the likes as well as guide sheaves.

The advantages offered by the first aspect of the invention are mainly as follows. When the winches wind down their wire ropes, the elevation guides extend downward and the guide frames descend, both by their dead loads. By stopping the guide frames at such positions as the guide flippers protrude downward beyond the bottom of the container and winding up the wire ropes, the guide flippers are pressed on the front and back of the container. In this condition, the container is placed on the top of another container by utilizing the guiding function of the guide flippers. As the guide frames can be raised and lowered and the guide flippers can be positioned by operating the winches, the operation is easy and safe. Besides, the guide flippers require no particular locking devices, which makes their structure simple.

The advantages offered by the second aspect of the invention are mainly as follows. Actuating means extend the elevation guides downward and stop the guide frames at such positions as the guide flippers protrude downward beyond the bottom of the container. Then, the winches wind up the wire ropes to press the guide flippers on the front and back of the container; thus, the guide flippers become ready for guidance. As the guide flippers can be positioned by operating the winches, the operation is easy and safe. Besides, the guide flippers require no particular locking devices, which makes their structure simple.

The advantage offered by the third aspect of the invention is mainly as follows. The guide frames can be set in their lower positions by stopping the guide frames at such positions as the stoppers protrude downward beyond the bottom of the container, advancing the stoppers under the bottom of the container, moving the guide frames upward a little, and thereby pressing the stoppers on the bottom surface of the container. Thus, the guide frames can be set in their lower positions exactly and easily.

The advantage offered by the fourth aspect of the invention is mainly that, by extending and contracting the telescopic beams of the spreader body along the container length and the telescopic guide frames along the container width, the spreader can be adapted to various sizes of containers.

The advantage offered by the fifth aspect of the invention is mainly that while the guide frames are being lowered, the rollers roll on the front and back of the container to keep a certain distance between the guide frames and the container; thus, the interference between the guide frames and the protrusions including door knobs on the container, and damage which may otherwise occurs, can be prevented.

The advantage offered by the sixth aspect of the invention is mainly that because the elevation guides can be tilted outward by the tilting means before they are extended downward, the interference between the guide frames and the protrusions including door knobs on the container, and damage which may otherwise occurs, can be prevented.

The advantages offered by the seventh aspect of the invention are mainly as follows. When an excessive force in the direction of length of the container works on one of the paired guide frames, the relief valves of the oil-hydraulic motors of the winches open to bypass the driving oil pressure and allow the oil-hydraulic motors to be turned in the opposite direction by the external force; hence, the pulling strings loosen, and the guide frame gives in to the external force, lessening it. Therefore, the upper container does not cause positional slippage of the lower container. As soon as the external force is lessened, the relief valves close to restore the operation of the oil-hydraulic motors and the tension of the pulling strings. Accordingly, the work of piling up containers is not disturbed. The guiding function is reliable, and the work efficiency is high. Furthermore, because overloads on the system are immediately removed by the relief valves, the operating life of the spreader is elongated.

The advantages offered by the eighth aspect of the invention are mainly as follows. When an excessive force in the direction of width of the container works on one of the guide flippers, the relief valve of the oil-hydraulic cylinder of the guide flipper opens to bypass the pressurized oil and allow the inner tube and the guide flipper to give in to the external force; thus, the external force is lessened. Therefore, the upper container does not cause positional slippage of the lower container. As soon as the external force is lessened, the relief valve closes and the oil-hydraulic cylinder pulls back the guide flipper toward its guiding position. Accordingly, the guiding function is restored immediately, and the work efficiency is high. Furthermore, because overloads on the system are immediately removed by the relief valves, the operating life of the spreader is elongated.

BRIEF DESCRIPTION OF THE DRAWINGS

The features and advantages of the present invention will become more clearly appreciated from the following description in conjunction with the accompanying drawings, in which.

DETAILED DESCRIPTION OF THE PREFERRED EMBODIMENTS

Figure 1:
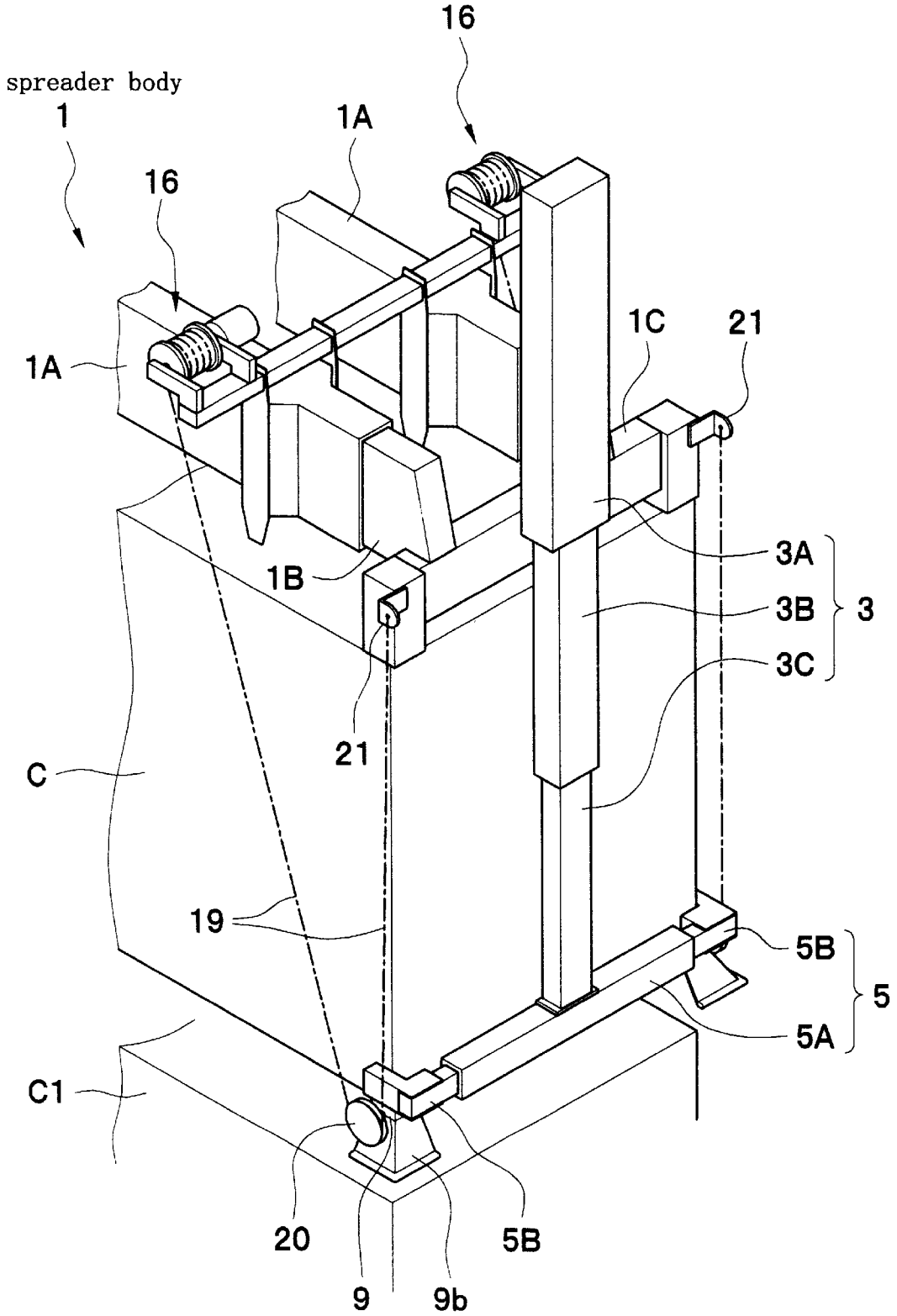
FIG. 1 is a perspective view of the characteristic portion of a container-piling spreader embodying the first aspect of the invention.

With reference to the drawings, a preferred embodiment of the present invention will now be described.

In FIGS. 1–4, the alphabet C designates a container; the numeral 1, a spreader body. The spreader body 1 comprises a pair of main beams 1A, two pairs of inner beams 1B, and a pair of connecting beams 1C. Mounted on the main beams 1A are four sheaves (not shown) which four wire ropes from a crane or the like engage.

At both ends of each main beam 1A, the inner beams 1B of one pair are telescopically inserted, and this telescopic beam comprising the three members is extended and contracted in the longitudinal direction of the container by a driving means (such as oil-hydraulic cylinder or chain driving mechanism), which will be described later. On each side of the front and back of the container C, the outer ends of the inner beams 1B are connected by one of the paired connecting beams 1C lying in the direction of width of the container C.

Provided on the bottom surface of each end portion of each connecting beam 1C is a known engaging means such as a twist lock (not shown), which engages one of the engaging holes provided in the four corners of the top of the container C.

Erected on the top, center portion of each connecting beam 1C is a bracket, on which an elevation guide 3 is mounted by its bracket and a pin 4, the connection allowing the elevation guide 3 to swing freely in a vertical plane.

Each elevation guide 3 comprises two or more members inserted in one another telescopically. In the embodiment shown in FIG. 1–4, each elevation guide 3 has a three-step telescopic construction, comprising an outer tube 3A, a middle tube 3B, and an inner tube 3C.

The bottom end of the inner tube 3C of each elevation guide 3 is provided with a guide frame 5 lying in the direction of width of the container C.

Each guide frame 5 comprises an outer tube 5A and a pair of inner tubes 5B, the outer tube 5A held horizontally at the bottom of the inner tube 3C, the paired inner tubes 5B inserted telescopically in both ends of the outer tube 5A. Each guide frame 5 is provided with a pair of telescopic cylinders 6 to extend and contract it, each telescopic cylinder connecting between the outer tube 5A and one of the inner tubes 5B. These telescopic cylinders 6 correspond to the actuating means mentioned in the eight aspect of the present invention.

Figure 5:
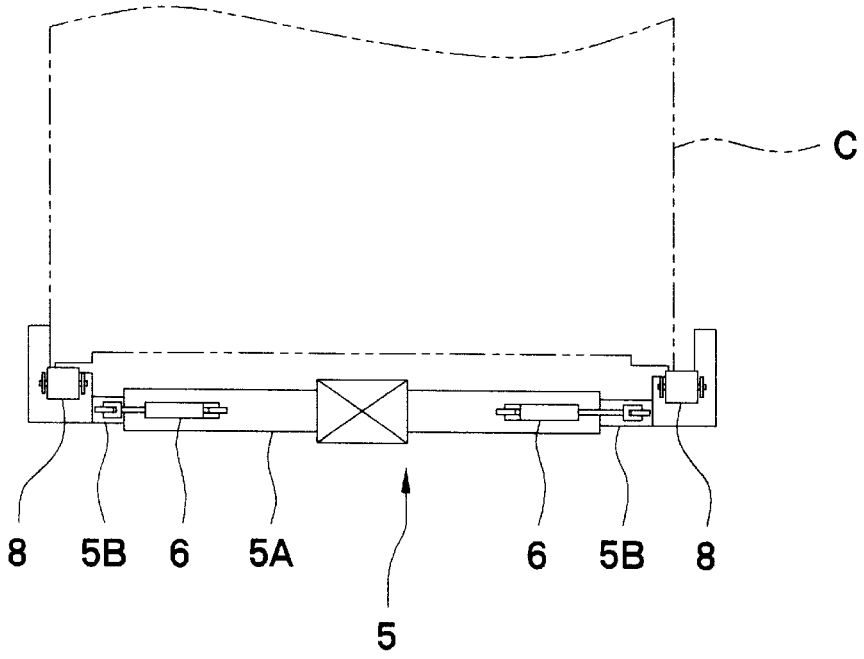
FIG. 5 is a top view of one of the paired guide frames of the spreader.
Figure 6:
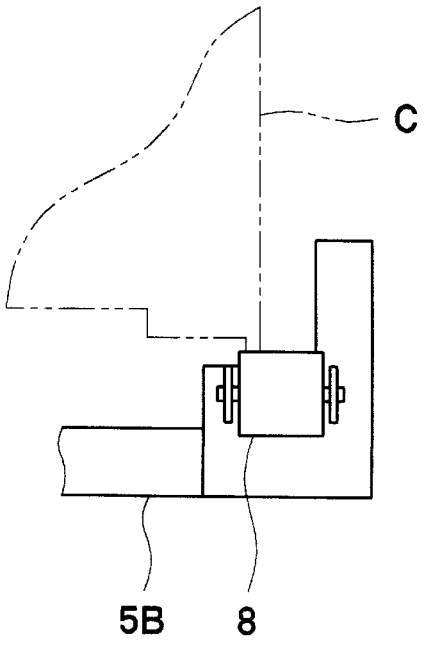
FIG. 6 is an explanatory drawing of the function of the rollers 8 mounted on the guide frames.
Figure 7:
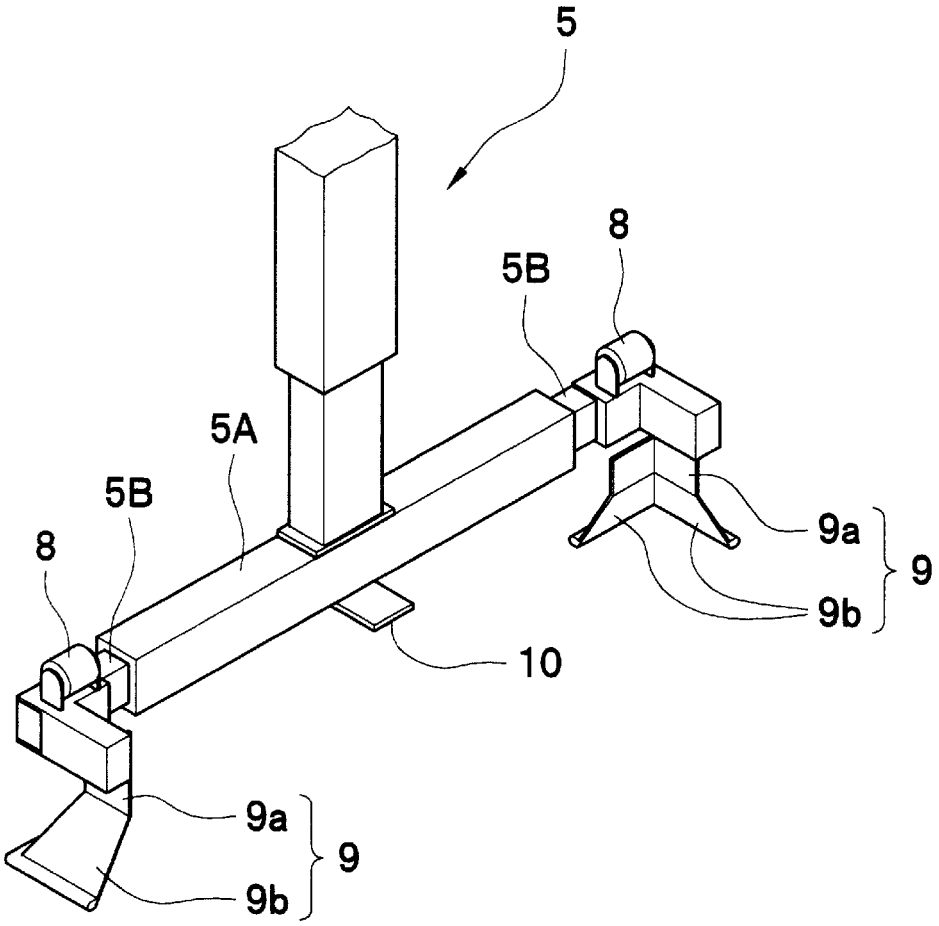
FIG. 7 is a perspective view of one of the guide frames as seen from its inside.

As shown in FIGS. 5–7, the outer ends of the inner tubes 5B of each guide frame 5 are each provided with a L-shaped guide flipper 9. Each guide frame 5 positions itself against a container C by catching it, from both its sides, with these right and left guide flippers 9.

A roller 8 is mounted on the top of each inner tube 5B by a bracket, journaled in the bracket. These paired rollers 8 on each side of the front and back of the container C roll on and along the right and left, vertical corner edges of the container C to keep a certain distance between the guide frame 5 and the container so that the door knobs and other various protrusions of the container C do not interfere with the up and down movement of the guide frame 5.

Each guide flipper 9 has a connecting portion 9*a* and an expanding portion 9*b*. The expanding portion 9*b* is formed by a guide plate, which extends downward expanding outward and is so positioned that it comes in contact with the two sides of a corner on the top of a container C.

Figure 9:
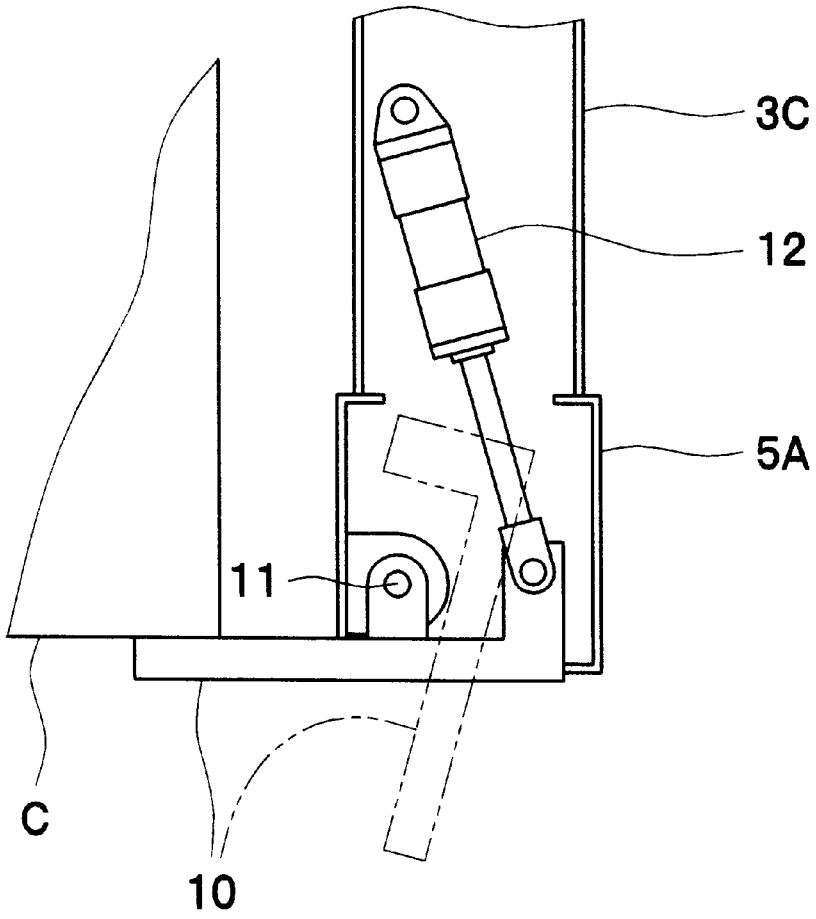
FIG. 9 is an side view of one of the retractable stoppers mounted on the guide frames.

In FIG. 9, the numeral 10 designates a stopper provided to the outer tube 5A of each guide frame 5. The stopper is, at its middle portion, journaled on a pin 11 provided in the outer tube 5A. The piston rod of an actuating cylinder 12 is connected to the base end of the stopper 10, and the base end of the actuating cylinder 12 is journaled in the inner tube 3C of the elevation guide 3. Therefore, by operating the actuating cylinder 12, the stopper 10 can be moved between the advance position to catch the bottom of the container C (shown by the solid lines) and the retreat position (shown by the dash-double dot lines).

Figure 2:
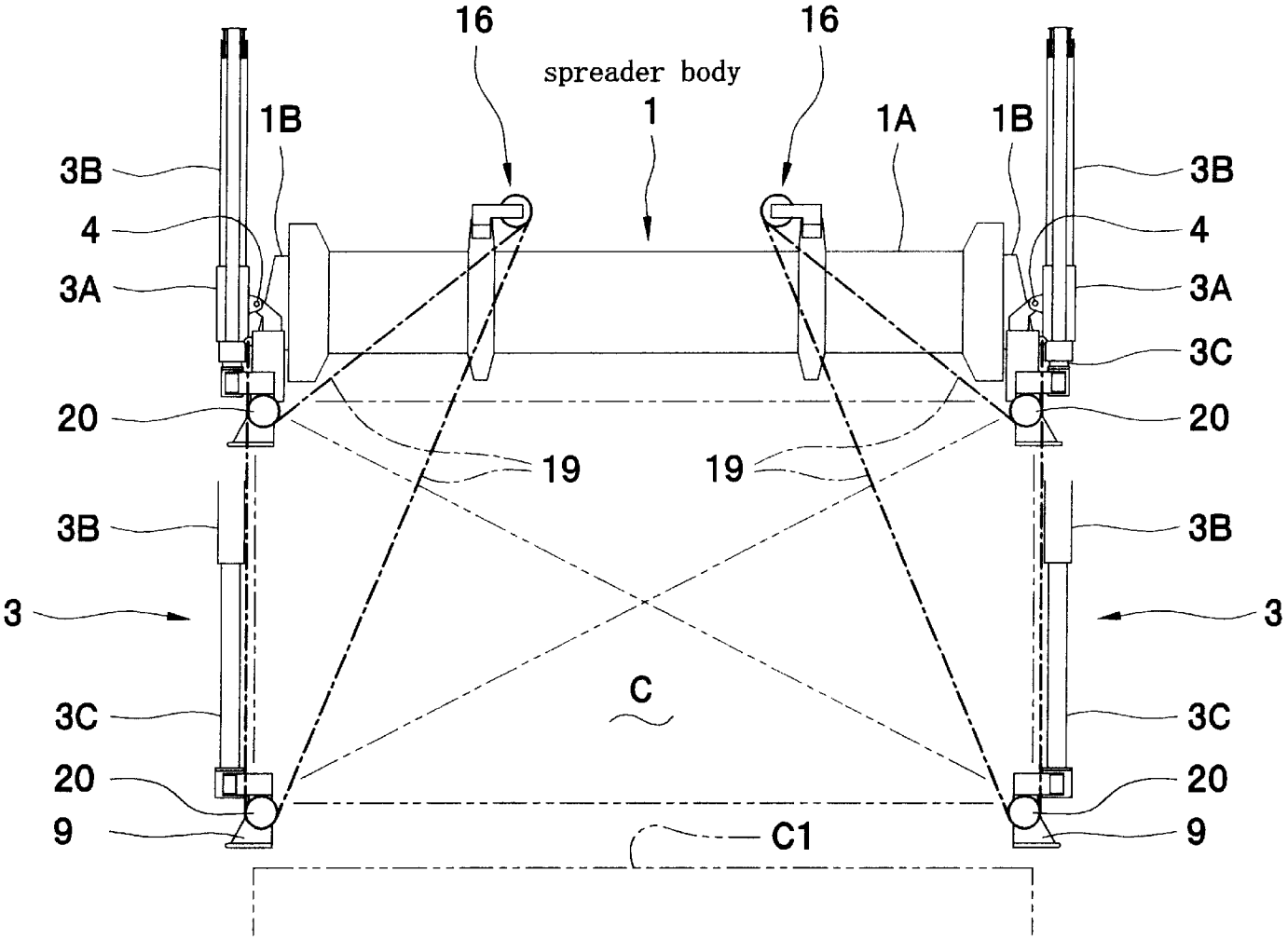
FIG. 2 is a side view of the spreader.
Figure 3:
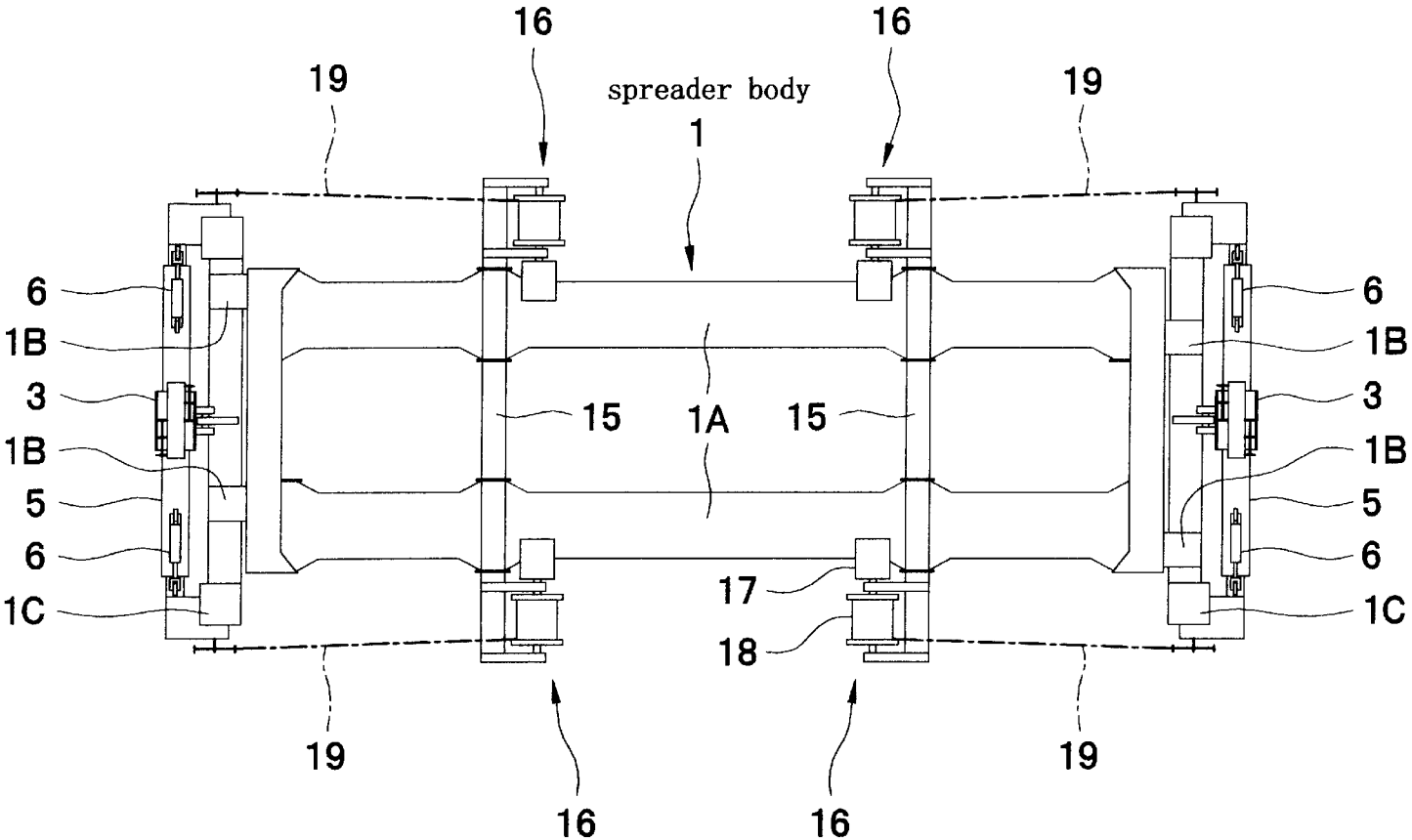
FIG. 3 is a plan view of the spreader.
Figure 10:
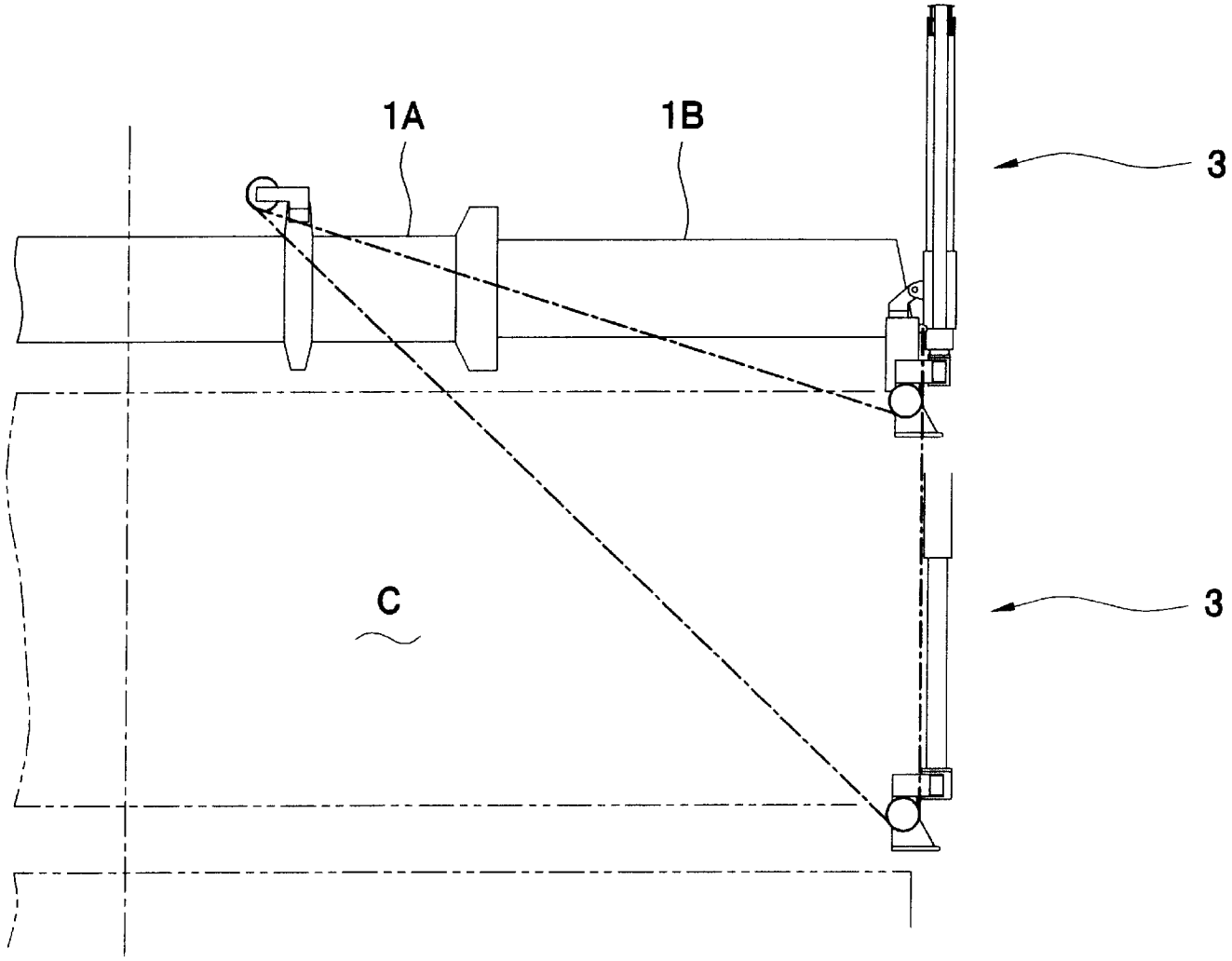
FIG. 10 is a side view of the spreader, its telescopic beams extending.

In FIG. 2, the inner beams 1B are retracted in the main beams 1A. In FIG. 10, the inner beams 1B are protruded from the main beams 1A. By protruding and retracting the inner beams 1B as shown in these figures, the spreader can handle containers of different lengths.

Figure 4:
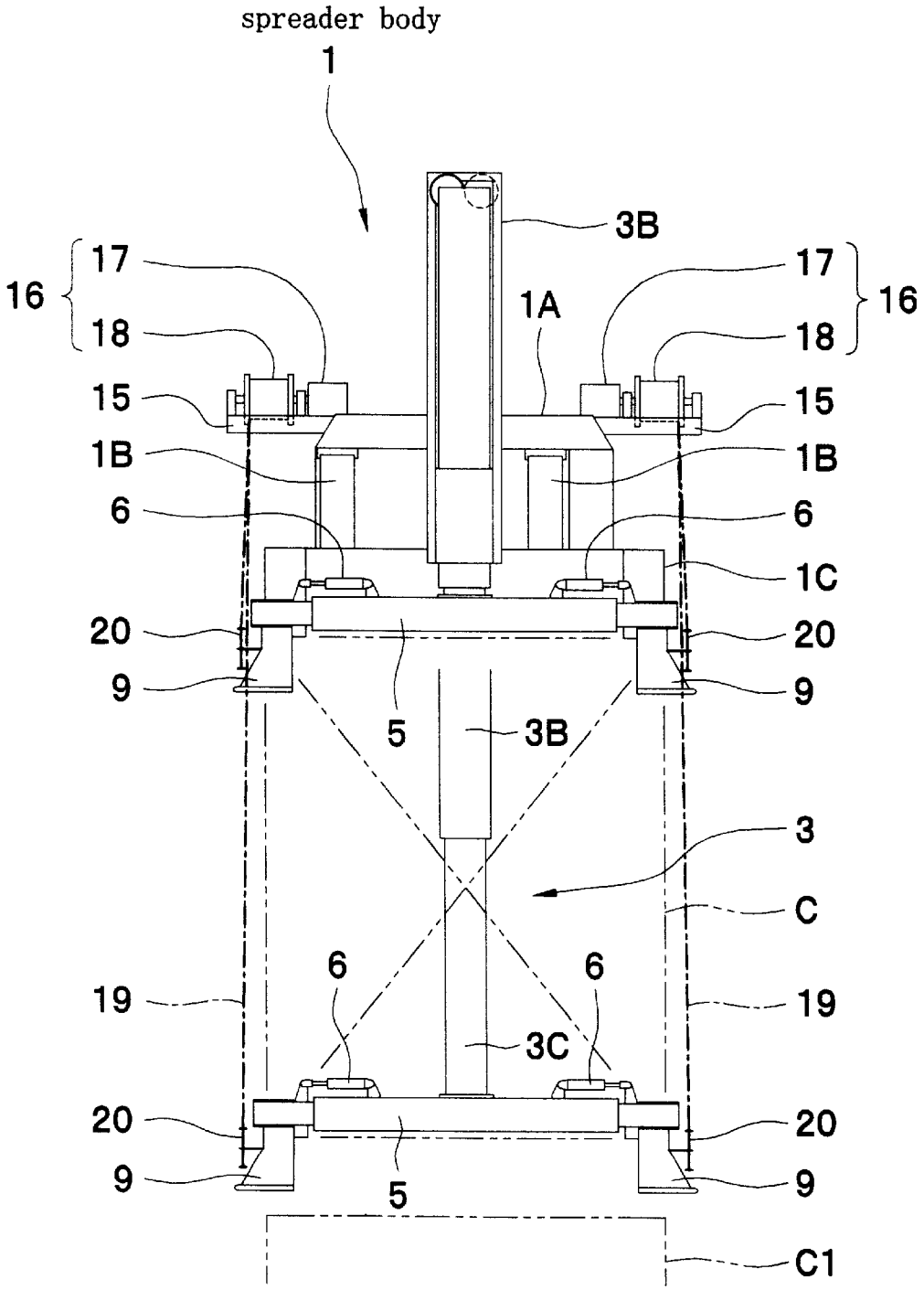
FIG. 4 is a front view of the spreader.

In addition, as is shown in FIGS. 1 and 4, the guide frames 5 can freely be extended and contracted. By operating the telescopic cylinders 6 to adjust the length of the guide frames 5 to the widths of containers, the guide frame 5 can cope with containers of different widths.

As shown in FIGS. 1–4, four winches are mounted on the cross beams 15 on the main beams 1A of the spreader body 1. Each winch 16 comprises an oil-hydraulic motor 17 and a drum 18. Each drum 18 has a wire rope 19 wound around it.

On the other hand, a guide sheave 20 is journaled on a side of each guide flipper 9. The wire rope 19 on each drum 18 goes around the guide sheave 20 and upward to an appropriate point on the spreader body 1, for instance, to a bracket 21 on the end portion on the connecting beam 1C, where it is fixedly terminated.

As shown in FIGS. 2 and 4, when the winches 16 wind up their wire ropes 19, the guide frames 5 are pulled up, their telescopic elevation guides 3 contracted. When the winches 16 wind down their wire ropes 19, the guide frames 5 descend due to their dead loads.

While the guide frames 5 are resting at the bottom of the container C, the guide frames 5 can be pressed against the container C for their positioning by putting the stoppers 10 in their advance positions under the bottom of the container C and winding up the wire ropes 19 to pulled up the stoppers 10 against the bottom of the container C.

The positioning of the guide frames 5 at the bottom of the container C can also be accomplished, without stopper 10, by obtaining the data of the length of containers and controlling the length of the wire ropes 19 to be wound down.

Figure 11:
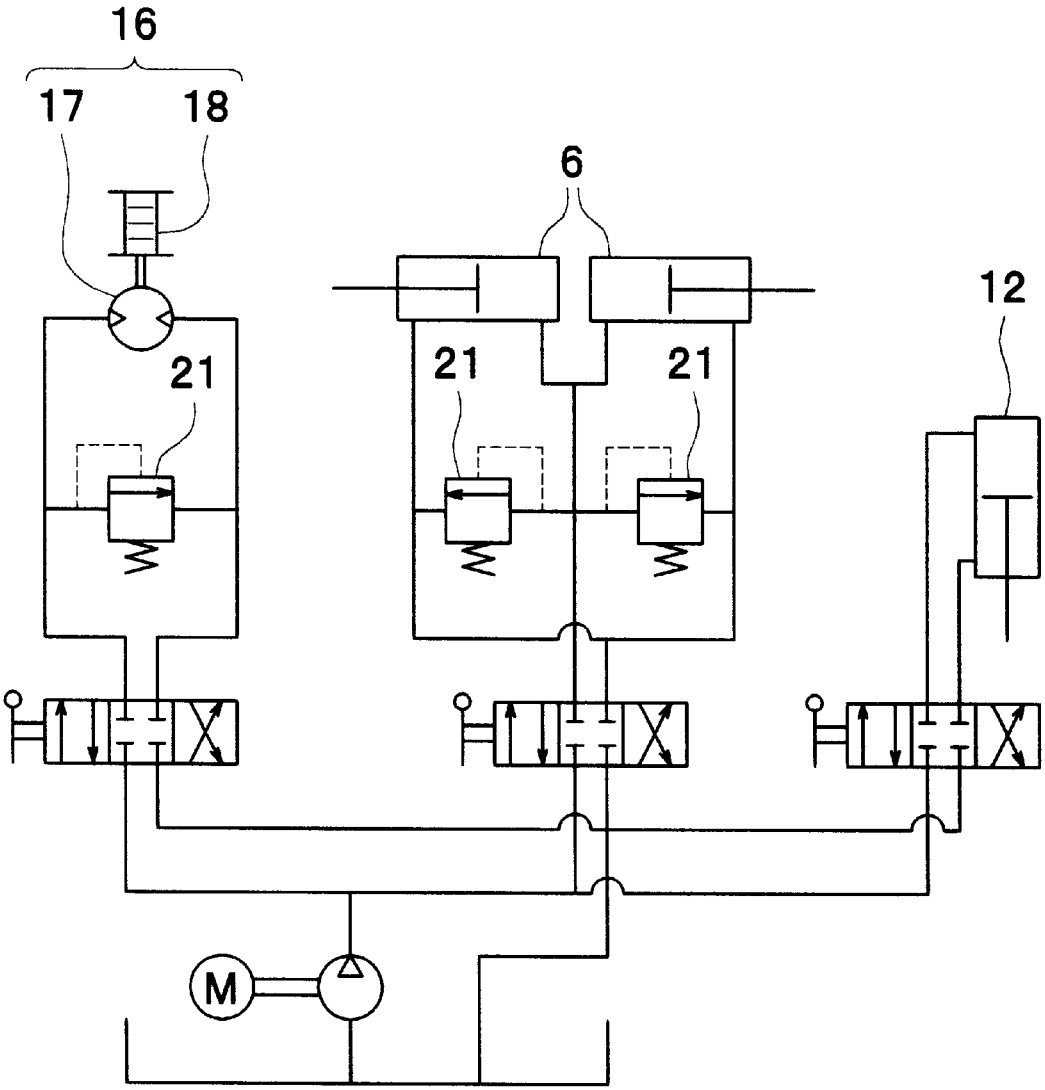
FIG. 11 is an oil-hydraulic circuit diagram of the spreader.

FIG. 11 is an oil-hydraulic circuit diagram, which hows the oil-hydraulic circuit of the oil-hydraulic motor 17 of a winch 16, the pair of telescopic cylinders 6 for the inner tubes 5B of a guide frame 5, and the actuating cylinder 12 of a stopper 10. The oil-hydraulic circuits for the other unshown oil-hydraulic motors 17 and telescopic and actuating cylinders 6 and 12 are configured in the same way.

A relief valve 21 is connected between the two supply/discharge pipes leading to the two ports of each oil-hydraulic motor 17. Each telescopic cylinder 6 is also provide with a relief valve between the supply/discharge pipe leading to the chamber for protruding the piston rod and the supply/discharge pipe leading to the chamber for retracting the piston rod. Accordingly, when an excessive tension occurs in one of the wire ropes 19 pulling up the guide frames 5, the oil pressure of the oil-supplying pipe of the oil-hydraulic motor 17 rises over the preset value, and the relief valve 21 opens, allowing the motors 17 to be turned in the opposite direction by the excessive tension; thus, the overload on the system is immediately removed. As soon as the overload is removed, the relief valve 21 closes, restoring the operation of the oil-hydraulic motor 17, the tension of the wire rope 19, and the guidance by the guide frame 5.

In the same way, when an excessive force works on one of the guide flippers 9, causing an overload on its telescopic cylinder 6 and its system, its relief valve 21 opens immediately to bypass the pressurized oil, thereby removing the overload. As soon as the overload is removed, the relief valve 21 closes, restoring the operation of the telescopic cylinder 6 and the guidance by the guide flipper 9.

With reference to FIG. 2 and 4, the method of putting a container C on another will now be described.

The winches 16 wind up the wire ropes 19 to raise the guide frames 5 to their upper positions. In this condition of the spreader body 1, the guide flippers 9 protrude below the connecting beams 1C with the twist locks. When the spreader body 1 is lowered slowly on a container C, the guide flippers 9 come in contact with the four corners of the top of the container C, and thereby the spreader body 1 can exactly be positioned onto the container C. Then, the twist locks engage the engaging holes on the container C.

Now, the container C is hoisted. To place the container Con a container C1, the guide frames 5 are extended and the winches 16 wind down the wire ropes 19 to lower the guide frames 5.

When the stoppers 10 are lowered below the bottom of the container C, the actuating cylinders 12 push the stoppers 10 into their advance positions. When the winches 16 wind up the wire ropes 19, the guide frames 5 are pulled up a little and the stoppers 10 come in contact with the bottom of the container C. Now, the guide flippers 9 are in their guiding positions, protruding a little below the bottom of the container C. When the wire ropes 19 are further wound up, the guide frames 5 are pressed on the front and back of the container C. Then, the guide frames 5 are contracted to catch the container C between the guide flipper 9; thus, the guide frames can exactly be positioned at the bottom of the container C. Some gap may be left between each guide flipper 9 and the container C, when the guide frames 5 are contracted.

Figure 8:
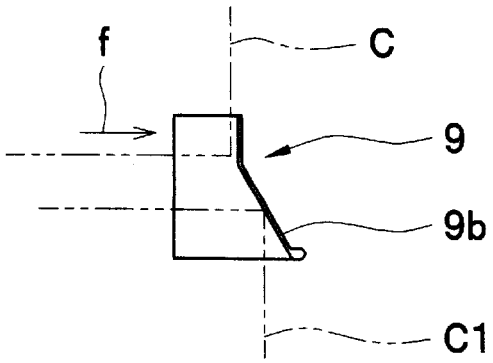
FIG. 8 is an explanatory drawing of the guiding function of the guide flippers mounted on the guide frames.

Next, the container C is lowered slowly on another container C1, and the expanding portions 9*b* of the guide flippers 9 come in contact with the four top corners of the container C1 to adjust the position of the upper container C to that of the lower container C1, as is shown in FIG. 8; namely, the positional slippage between the containers C and C1 is eliminated by moving the upper container C in the "f" direction. Therefore, with this spreader body 1, a container C can be put on another C1 without positional slippage between them.

During the work of putting a container on another, external forces to which the guide frames 5 may be subjected are in three directions; i.e., the direction of length of the container, the direction of width of the container, and the vertical direction. An external force working on one of the guide frames 5 in the direction of length of the container C is received by its wire ropes 19, and the relief valves 21 open to relieve the system from the overload. As soon as the overload is removed, the relief valves 21 close to restore the operation of the oil-hydraulic motors 17; thus, the tension of the wire ropes 19 and hence the guidance by the guide frame 5 are immediately restored.

An external force working on one of the guide flippers 9 in the direction of width of the container C is received by its telescopic cylinder 6, and its relief valve 21 opens to relieve the system from the overload and allow the piston rod, and the inner tube 5B connected to it, to be pulled out by the external force. As soon as the overload is removed, the relief valve 21 closes to restore the oil pressure and return the guide flipper 9 to its guiding position; thus, the operational efficiency is hardly disturbed.

When one of the guide flippers 9 is exposed to an external force in a vertical, upward direction, the actuating cylinder 12 pushing the stopper 10 against the bottom of the container C and thereby retaining the guide frame 5 at the bottom of the container C gives in to the external force and contracts, thereby lessening the external force.

By lessening external forces in the three directions and removing overloads on the system as described above, the neatly piled-up condition of lower containers is not disturbed and, in addition, the operating life of the spreader is elongated.

Now, an embodiment of the second aspect of the invention will be described.

Figure 12:
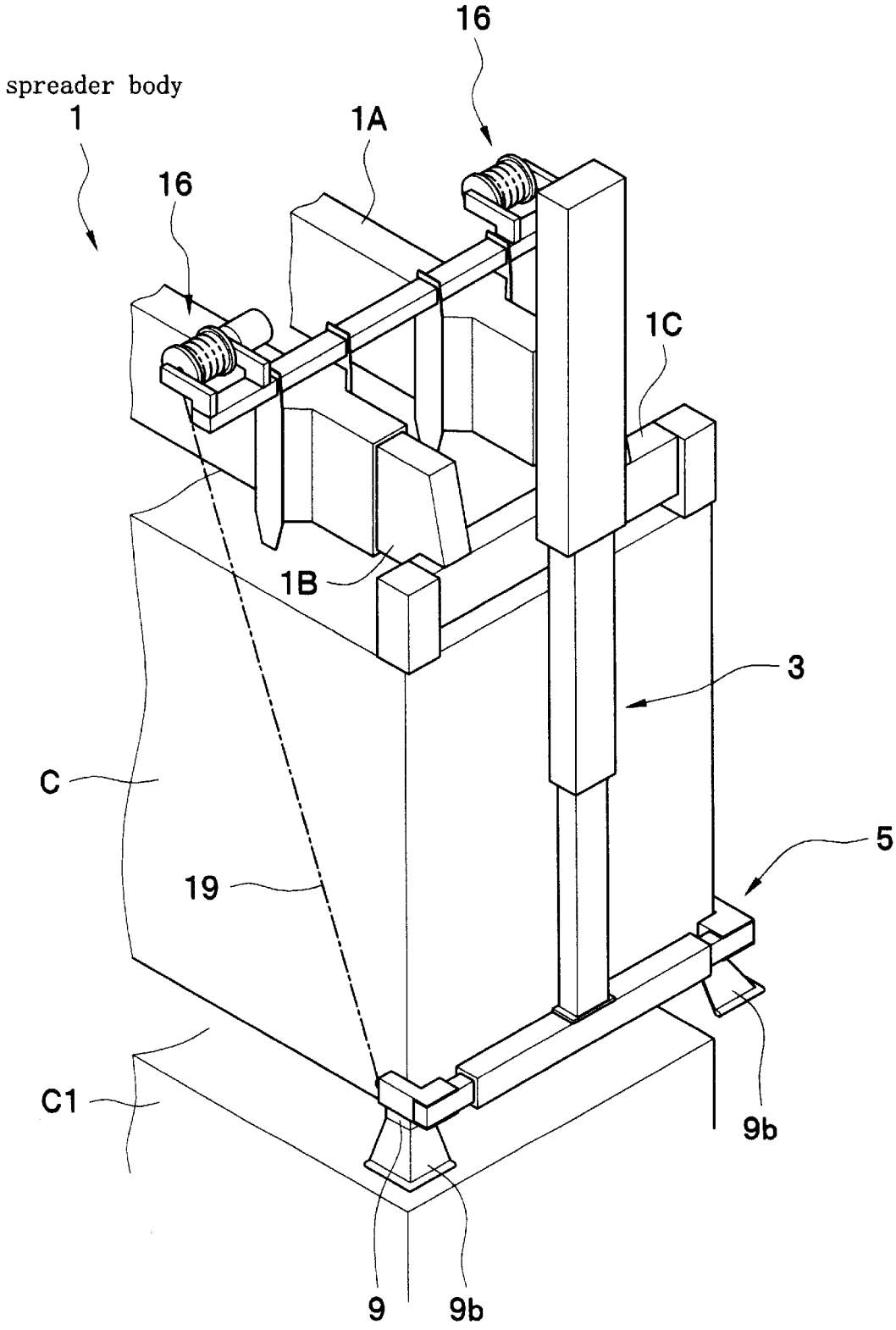
FIG. 12 is a perspective view of the characteristic portion of a container-piling spreader embodying the second aspect of the invention.

FIG. 12 is a perspective view of the characteristic portion of a spreader embodying the second aspect of the invention.

Figure 13:
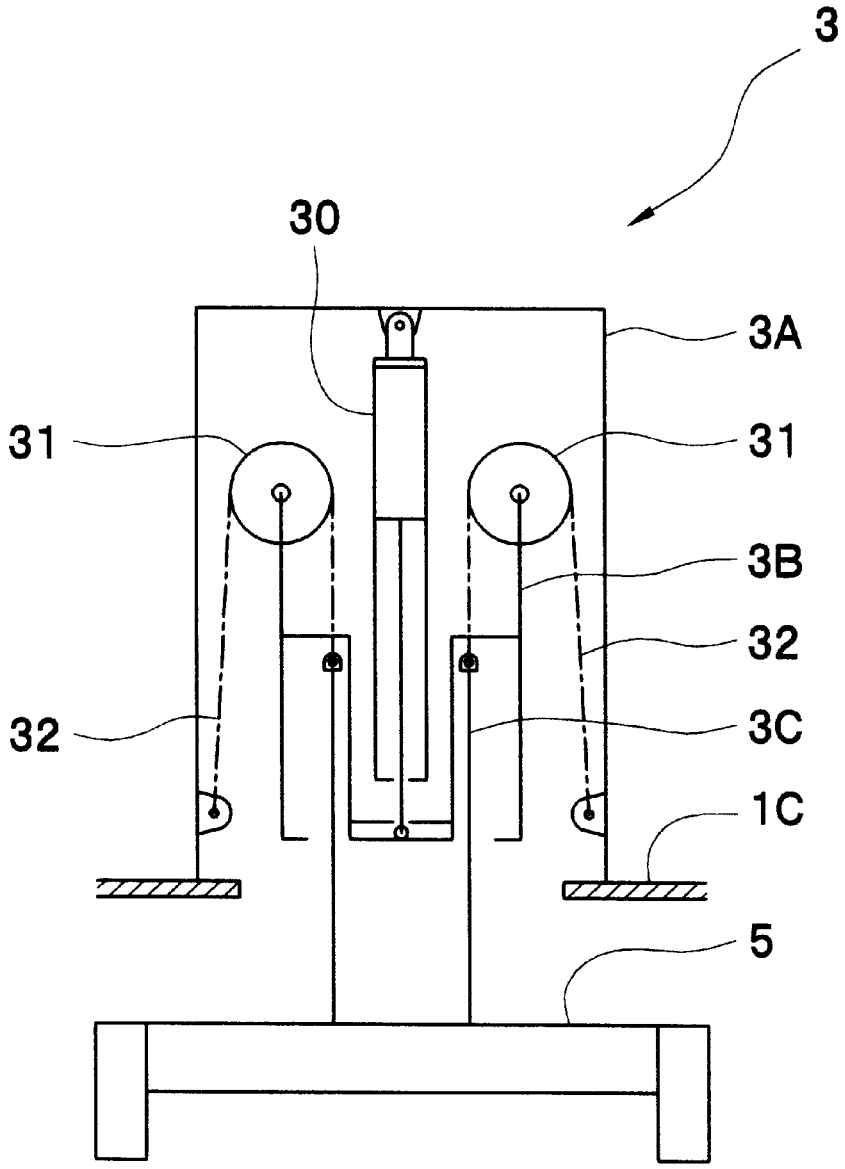
FIG. 13 is an explanatory drawing of the structure of another form of the paired elevation guides of the spreader of the present invention.

FIG. 13 is an illustration of the structure of one form of the elevation guide 3.

In the second aspect of the invention, the spreader is provided with actuating means to extend and contract the elevation guides 3, and the wire ropes 19 of the winches 16 are directly connected to the guiding portions 9.

The actuating means to extend and contract the elevation guides 3 are under no particular restrictions, and known actuators such as cylinders or winches can be used.

FIG. 13 shows one form of the elevation guide 3 of the second aspect of the invention. The symbol 3A designates an outer tube fixed to each connecting beam 1C of the spreader body 1. The symbol 3B designates a middle tube inserted in the outer tube 3A; 3C, an inner tube inserted in the middle tube 3B. An oil-hydraulic cylinder 30 is connected between the outer tube 3A and the middle tube 3B. Two sheaves 31 are journaled on the top of the middle tube 3B. A wire rope 32 is laid on each guide sheave 31, and its one end is fixed to the bottom portion of the outer tube 3A; the other end, to the top of the inner tube 3C.

Given the above structure, when the oil-hydraulic cylinder 30 extends or contracts to lower or raise the middle tube 3B, the movement of the middle tube 3B is conveyed to the inner tube 3C through the guide sheaves 31 and the wire ropes 32, and hence the inner tubes 3C and the guide frame 5 are lowered or raised. As an alternative, another oil-hydraulic cylinder, instead of the guide sheaves 31 and wire ropes 32, may be used between the middle tube 3B and the inner tube 3C.

According to this embodiment, the elevation guides 3 are extended by the oil-hydraulic cylinders 30 to lower the guide frames 5 to their lower positions, and the stoppers 10 are moved to their advance positions under the bottom of the container C. When the winches 16 wind up the wire ropes 19, the guide flippers 9 are pulled to the front and back of the container C and positioned. Then, in the same way as with the spreader of the first embodiment, the container C is guided and positioned precisely onto the lower container C1 by the guide flippers 9.

The positioning of the guide frames 5 at the bottom of the container C can also be accomplished, without stopper 10, by obtaining the data of the length of containers and extending the oil-hydraulic cylinders 30 and so on, based on such data.

Other embodiments of the present invention will now be described.

Figure 14:
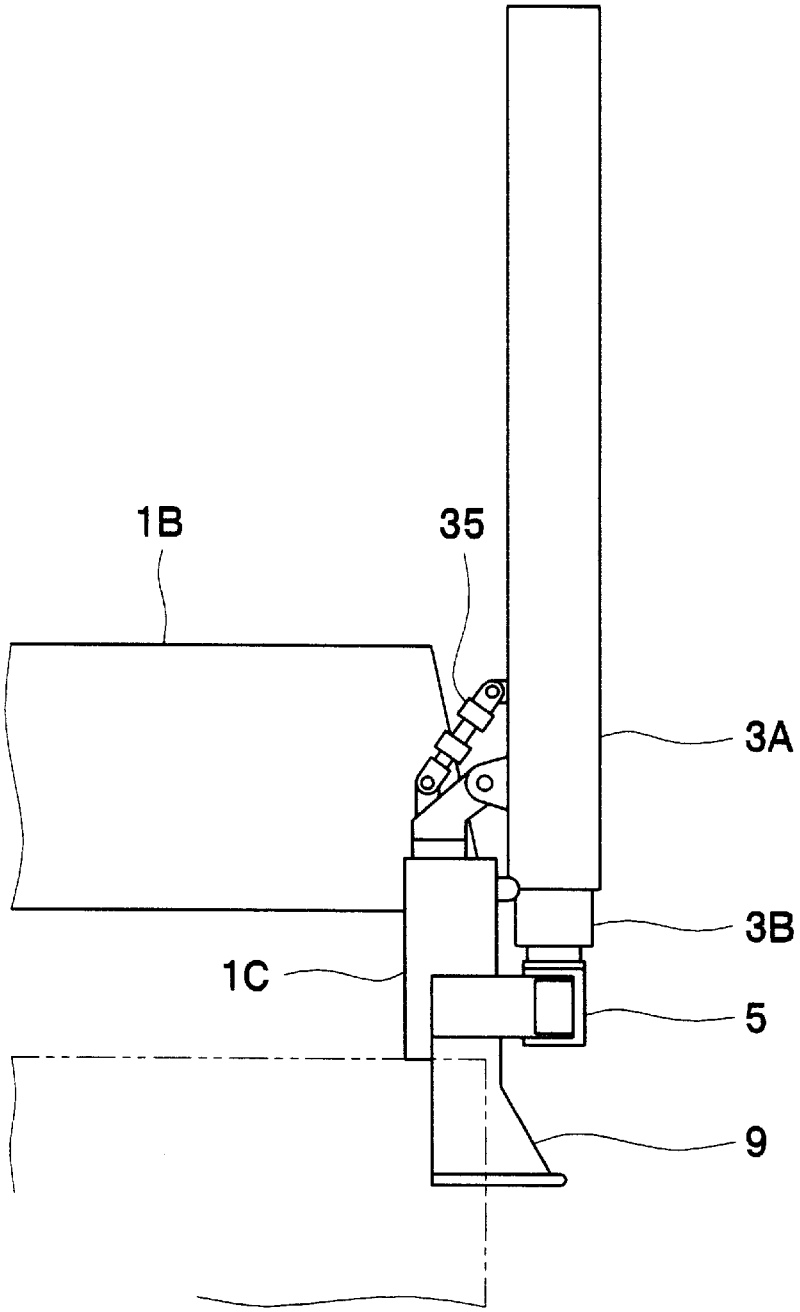
FIG. 14 is a side view of one form of a tilting means for the paired elevation guides of the spreader of the present invention.

In the embodiment of FIG. 14, on each side of the front and back of the container C, a tilting cylinder 35 to tilt the elevation guide 3 is connected between the connecting beam 1C of the spreader body 1 and the outer tube 3A of the elevation guide 3. These tilting cylinders 35 corresponds to the tilting means mentioned in the sixth aspect of the present invention.

In this embodiment, because the elevation guides 3 can be tilted outward before they are extended, the interference between the guide frames 5 and the door knobs and other protrusions on the container C can be avoided without the rollers 8 shown in FIGS. 5–6.

Figure 15:
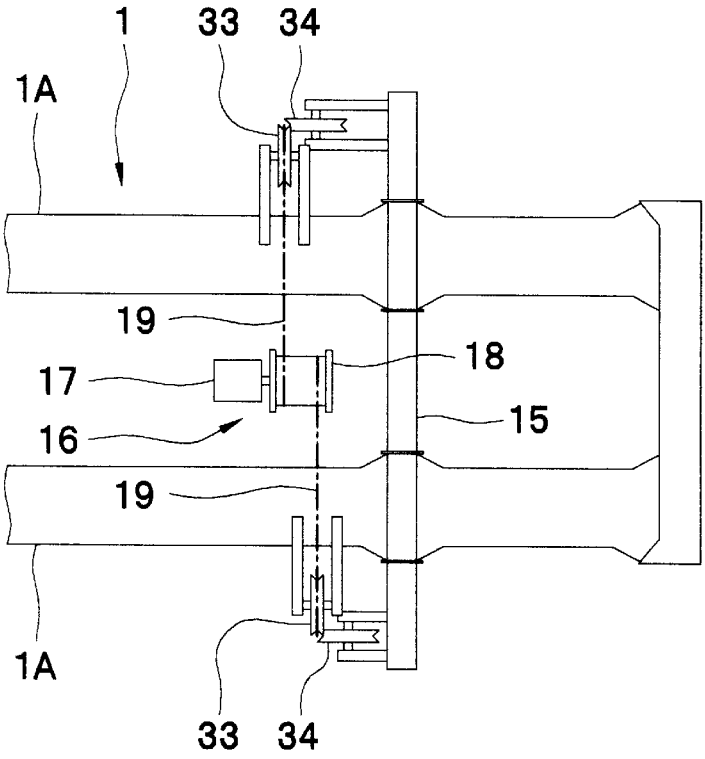
FIG. 15 is a plan view of another arrangement of winches for the paired guide frames.
Figure 16:
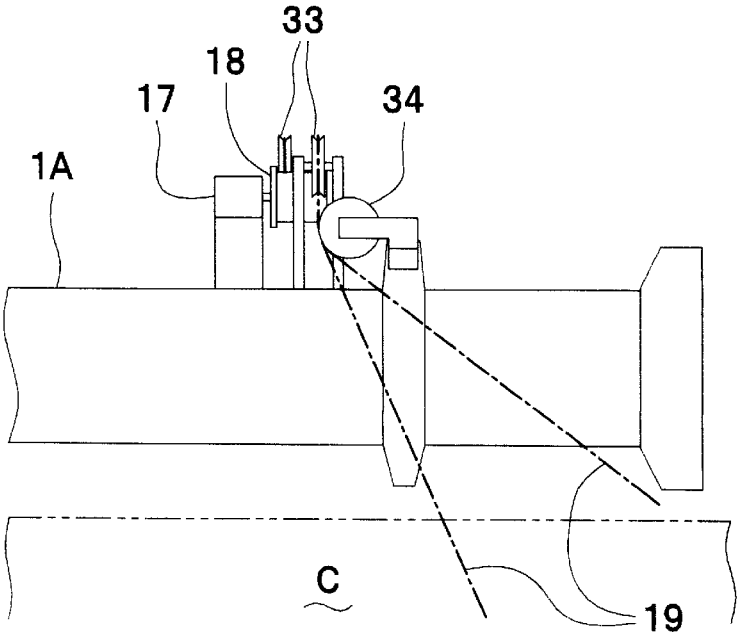
FIG. 16 is a side view of the winches of FIG. 15.
Figure 17:
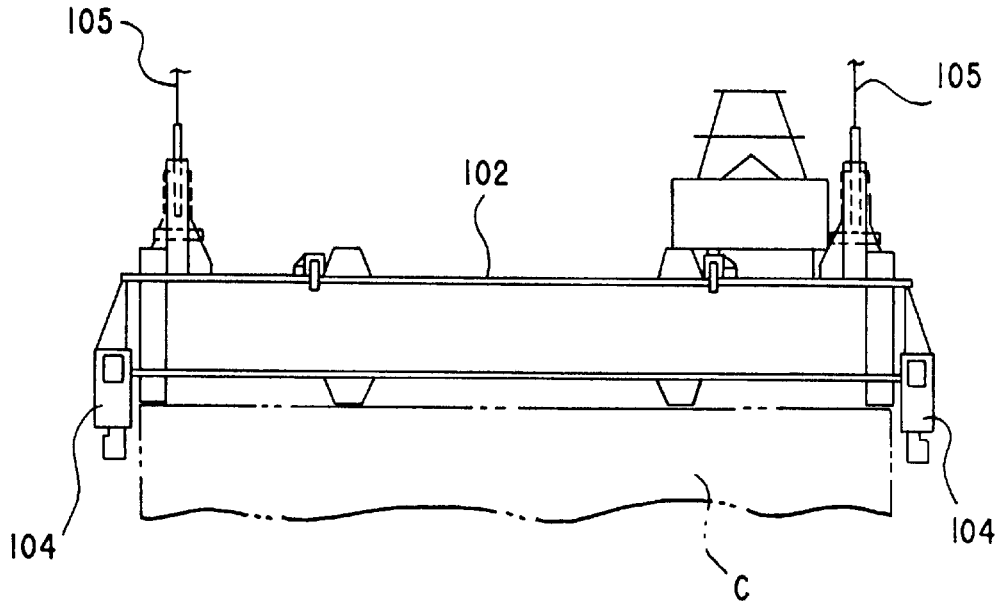
FIG.17 PRIOR ART
FIG. 17 is a side view of a conventional spreader.
Figure 18:
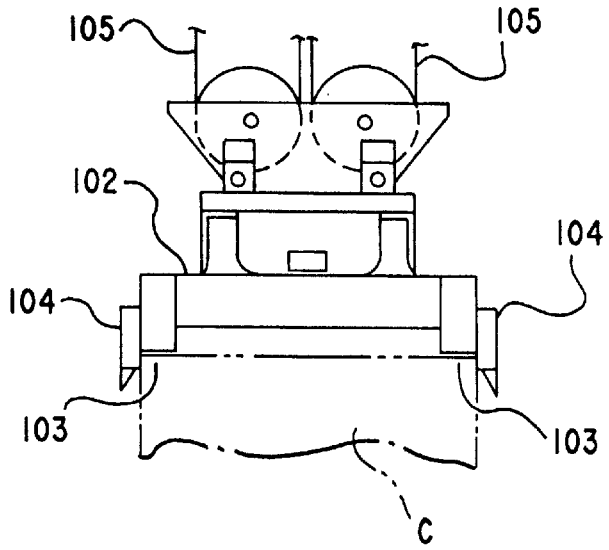
FIG.18 PRIOR ART
FIG. 18 is a front view of the spreader of FIG. 17.
Figure 19:
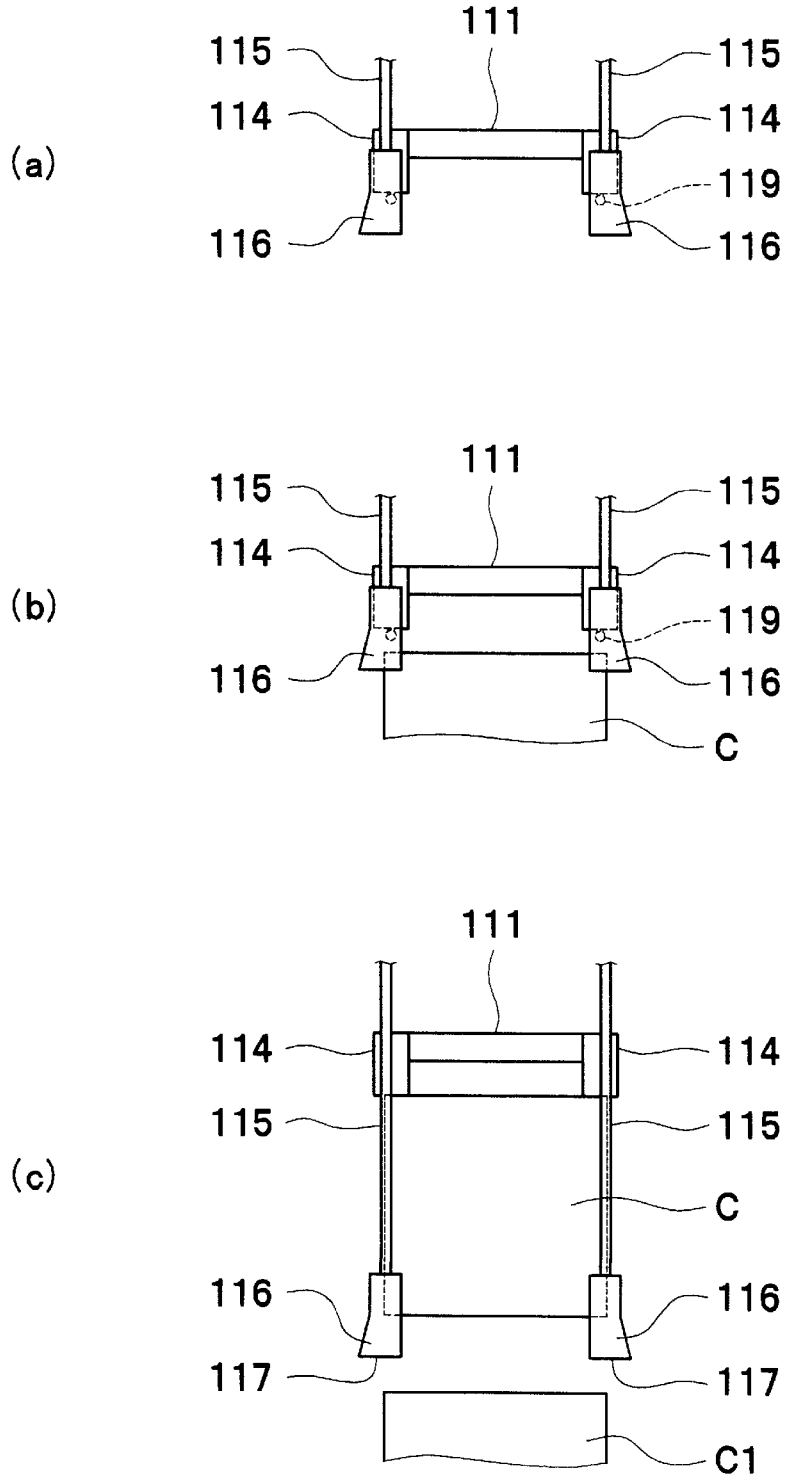
FIG. 19 Prior art
FIG. 19 is an explanatory drawing of the container-piling procedure by a spreader of the prior art I.

FIGS. 15 and 16 shows another configuration of winches 16. Although four winches 16 are used in the embodiments described earlier, the same function can be achieved with two winches. On each side of the front and back of the container C, a winch 16 is provided on the spreader body 1 at the center between the paired main beams 1A. Two wire ropes 19 are wound on the drum 18, each in the opposite direction, and each wire rope 19 goes around a sheave 33 on the main beam 1A and around another sheave 34 on a cross beam 15 and further to the guide flipper 9 or a guide sheave 20 mounted on the guide flipper 9. The advantage of this embodiment is that the number of winches is reduced to a half, decreasing the manufacturing cost of the spreader.

In the above embodiments, although wire ropes 19 are wound around the winches 16, block chains, roller chains, or the likes may be used. In case that chains are used, sprockets are used instead of the guide sheaves 20, 33, and 34.

In the above embodiments, although the spreader body 1 comprises two main beams 1A, one wider main beam may be used instead of them. In this case, the wider main beam may accommodate a pair of wider inner beams instead of the two pairs of the inner beams 1B.

The invention may be embodied in other specific forms without departing from the spirit or essential characteristics thereof. The above embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A container-piling spreader comprising:

a spreader body having, on the four corners of its bottom surface, means for engaging and hanging a container; a pair of elevation guides, the two elevation guides being mounted on the front end and the rear end, respectively, of the spreader body so as to be swingable in a vertical plane, and extendible downward and contractible upward;

a pair of guide frames, each guide frame mounted, horizontally and in the direction of width of the container, on the bottom of one of the paired elevation guides;

a pair of retractable stoppers, each of which is mounted on one of the paired guide frames and can be advanced to catch the bottom of the container hoisted by the spreader body and retracted from an advanced position;

two pairs of guide flippers, the guide flippers of each pair mounted on both ends, respectively, of one of the paired guide frames;

two pairs of direction-changing guides, each direction-changing guide mounted on a side of one of the guide flippers;

at least one pair of winches mounted on the spreader body, one winch being disposed near the front end of the spreader body, the other winch being disposed near the rear end of the spreader body; and two pairs of pulling strings, each pulling string having one end fixed substantially to a guide flipper and stretching diagonally upward to have the other end wound on one of the paired winches positionally corresponding to said guide flipper each of the paired winches being driven by an oil-hydraulic motor, each of the oil-hydraulic motors being provided with a relief valve which is connected between two oil-hydraulic lines leading to two inlet/outlet ports, respectively, of said oil-hydraulic motor.

2. A container-piling spreader according to claim 1, further comprising:

two oil-hydraulic cylinders, each extending and contracting one of the paired elevation guides and preventing said elevation guide from contracting under external force.

3. A container-piling spreader as claimed in claim 1 wherein:

the spreader body comprises (i) a pair of main beams lying in the longitudinal direction of the container, (ii) two pairs of inner beams, the inner beams of each pair being built in one of the main beams and being protrudable and retractable at both ends, respectively, of the main beam, and (iii) a pair of connecting beams lying in the direction of width of the container, one connecting beam being mounted on the outer ends of the inner beams on the front side of the container, the other connecting beam being mounted on the outer ends of the inner beams on the back side of the container;

the means for engaging and hanging a container are mounted on the bottoms of the connecting beams at their both ends;

each of the guide frames comprises (i) an outer tube, (ii) a pair of inner tubes, each inner tube being protrudable out of and retractable into the one end of the outer tube, and (iii) a pair of actuating means for the pair of inner tubes; and each of the four guide flippers is mounted on the outer end of one of the four inner tubes.

4. A container-piling spreader as claimed in claim 1, wherein:

on each side of the front and the back of the container, the guide frame is provided with a pair of rollers which roll on the front or the back of the container to keep a predetermined distance between the container and the guide frame while the guide frame is either one of ascending and descending.

5. A container-piling spreader as claimed in claim 1 wherein, on each side of the front and back of the container, a tilting means is provided between the spreader body and the elevation guide to tilt the elevation guide in a vertical.

6. A container-piling spreader as claimed in claim 1 wherein:

a pair of actuating means for the pair of inner tubes of each guide frame is a pair of oil-hydraulic cylinders; and a relief valve is connected between two oil-hydraulic lines leading to the two chambers, respectively, one chamber being for extension and the other chamber being for contraction, of each of the oil-hydraulic cylinders.

* * * * *